United States Patent [19]

Rydqvist

[11] Patent Number: 4,821,477

[45] Date of Patent: Apr. 18, 1989

[54] PARTITION PANEL SYSTEM

[76] Inventor: Sune S. L. Rydqvist, Hagmarksvägen 10, Hallsberg, Sweden, S-694 00

[21] Appl. No.: 143,279

[22] Filed: Jan. 7, 1988

Related U.S. Application Data

[63] Continuation of Ser. No. 913,650, Sep. 4, 1986, abandoned.

[30] Foreign Application Priority Data

Jan. 22, 1985 [SE] Sweden ..... 8500271

[51] Int. Cl.[4] ..... E04H 1/00; E04B 1/99; E04B 2/74

[52] U.S. Cl. ..... 52/239; 52/36

[58] Field of Search ..... 52/36, 144, 239

[56] References Cited

U.S. PATENT DOCUMENTS

| | | | |
|---|---|---|---|
| 3,180,459 | 4/1965 | Liskey, Jr. | 52/239 X |
| 3,777,437 | 12/1973 | Christen | 52/285 X |
| 3,949,827 | 4/1976 | Witherspoon | 52/239 |
| 4,090,335 | 5/1978 | Curatolo | 52/239 |
| 4,158,936 | 6/1979 | Fulton | 52/242 |
| 4,224,769 | 9/1980 | Ball et al. | 52/36 |
| 4,448,003 | 5/1984 | Hasbrouck | 52/239 |
| 4,685,255 | 8/1987 | Kelley | 52/36 |

FOREIGN PATENT DOCUMENTS

| | | |
|---|---|---|
| 1011915 | 6/1977 | Canada . |
| 0104804 | 4/1984 | European Pat. Off. . |

*Primary Examiner*—J. Karl Bell

*Attorney, Agent, or Firm*—Holman & Stern

[57] ABSTRACT

A partition panel system, including at least two from each other spaced longitudinally extending supporting sections (1, 1', 1''), having a first end portion arranged with a supporting member (2, 2', 2''), intended to take up contact with a floor surface and to maintain the supporting sections (1, 1', 1'') in a substantially vertical direction of extension. Each other adjacently located supporting sections (1, 1', 1'') are arranged internally connected by means of at least one frameshaped member, formed by an upper and a lower attachment member and two side members, said frameshaped member being arranged to support one or a number of plate-shaped members and/or to be surrounded by a layer, thus forming a wall surface unit (3, 3', 3''). At least one of the attachment members are arranged with a longitudinally extending groove, substantially centrally located at an outer restricting surface, which groove can serve for engagement with brackets (12, 13) intended to support a piece of furniture attachable against the partition panel, but also facilitating attachment of a strip-shaped member, utilized to stretch or cause tension in a textile material or similar, used to form a surrounding and outer layer.

14 Claims, 4 Drawing Sheets

PARTITION PANEL SYSTEM

This is a continuation of application Ser. No. 913,650, filed 9/4/86, now abandoned.

The present invention relates to partition panel system, intended to facilitate partitioning of restricted areas in larger premises, for example individual work areas in office landscapes.

DESCRIPTION OF THE PRIOR ART

Partition panels for the above stated purpose are previously known, comprising a supporting outer frame assembly, preferably manufactured from metal sections, arranged to support a flat sheet wall panel, painted in desired color, or covered by a suitable material. In order to maintain a vertical direction of extension in relation to a floor surface, the lower end portions of the vertically extending supporting sections are, for example, arranged with transversely extending support members. Since it often is desirable to attach shelves or similar members against the partition panels, the vertically extending supporting sections are usually arranged with equally spaced apertures, which can be used to engage supporting brackets attached to the shelves or any other elements to be supported by the partition panel.

The above disclosed previously known type of partition panels are made with a certain panel height when manufactured, which cannot be altered by a user. The possibility of attaching shelves, tops, cabinets and similar elements is based on the fact that such elements have a width extension substantially corresponding to the distance) between the vertically extending supporting sections, since the supporting brackets utilized otherwise can not engage existing holes or apertures. Furthermore, the holes or apertures utilized for engagement with such supporting brackets are from an aesthetic point of view undesirable, and a nonperforated smooth outer surface would obviously be preferred. By covering such partition panels with a textile material, a certain sound absorbing effect is achieved, but since the textile material is applied directly against included flat sheet panel, the effect is small. It is further difficult to create a partition panel having a varied surface, e.g. with different materials or colors included in one specific partition panel.

BRIEF SUMMARY OF THE INVENTION

The object of the present invention is to disclose a partition panel system, which removes all the above stated disadvantages related to previously known types of partition panels, and which facilitates simple and rapid erection, simple attachment of shelves, tops, cabinets and similar elements, having any desired extension in relation to the width of the partition panel. Included partition panels have good sound absorbing properties, and can also be varied in a most attractive fashion with regard to color and shape. Furthermore, included supporting sections are completely without the perforations or holes previously utilized to facilitate attachment of furniture elements. The partition panel system according to the present invention is further extremely well suited for erection of reception desks or other specific and individually adapted work positions, and also facilitate further advantages, as disclosed in the following descriptive specification.

The partition panel system according to the present invention includes at least two relatively spaced longitudinally extending supporting sections, which are at a first end portion arranged with a supporting member, intended to contact with a floor surface and to maintain the supporting sections in a substantially vertical direction of extension. This system is mainly characterized in that each other adjacently located supporting sections are arranged internally joined by means of at least one frame-shaped member, formed by an upper and a lower attachment member and two side members, said frame-shaped member being arranged to support one or a number of plate-shaped members and/or to be surrounded by means of a layer, thus forming a wall surface unit, at least one of the attachment members being arranged with a longitudinally extending groove, substantially centrally located at an outer restricting surface.

BRIEF DESCRIPTION OF THE DRAWINGS

Examples of embodiments of a partition panel system according to the present invention are more fully described below with reference to the accompanying drawings, wherein.

DETAILED DESCRIPTION

Figure 1:
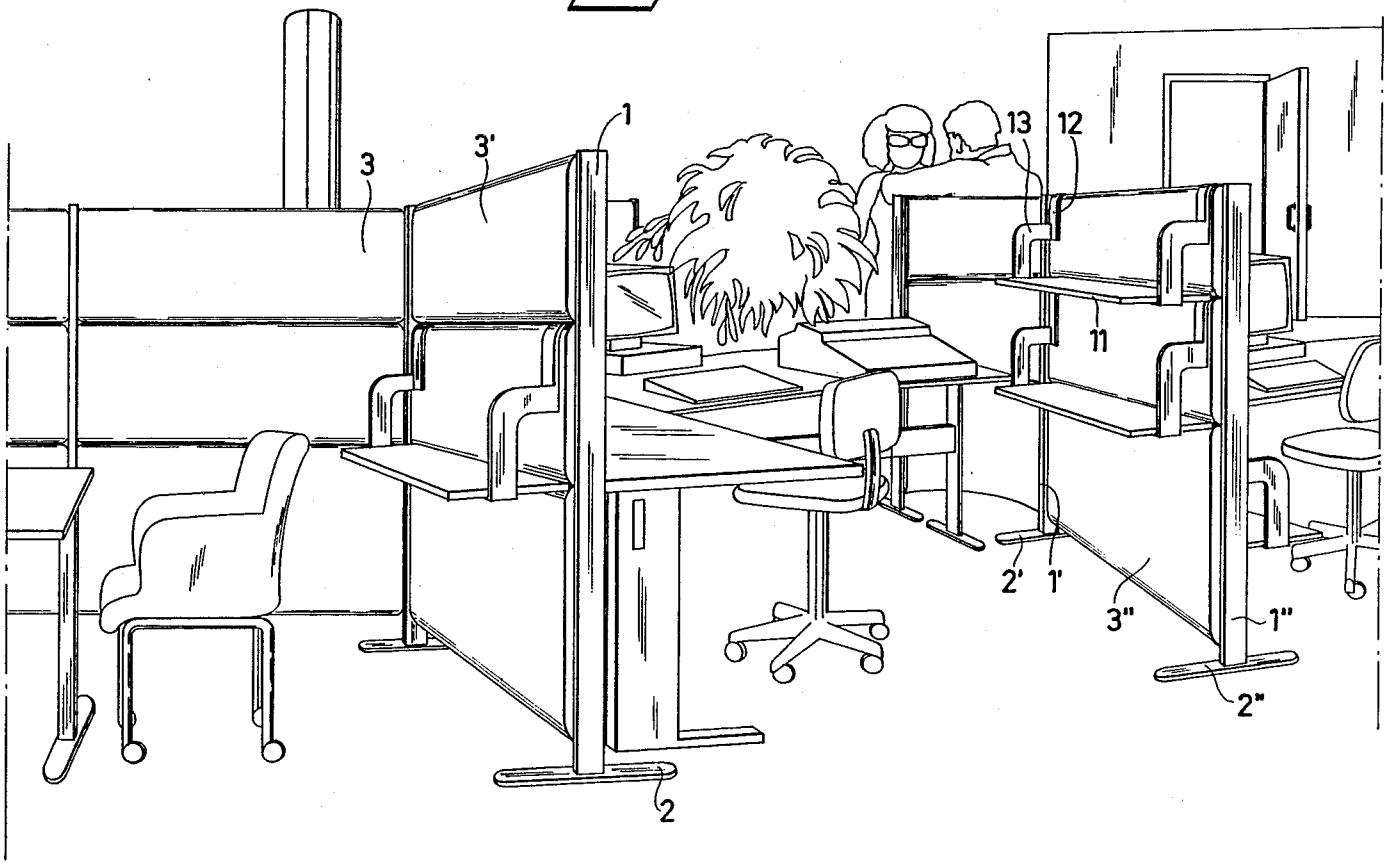
FIG. 1 is a perspective view of a part of an office landscape, including work positions divided from each other by means of a partition panel system according to the present invention.
Figure 2:
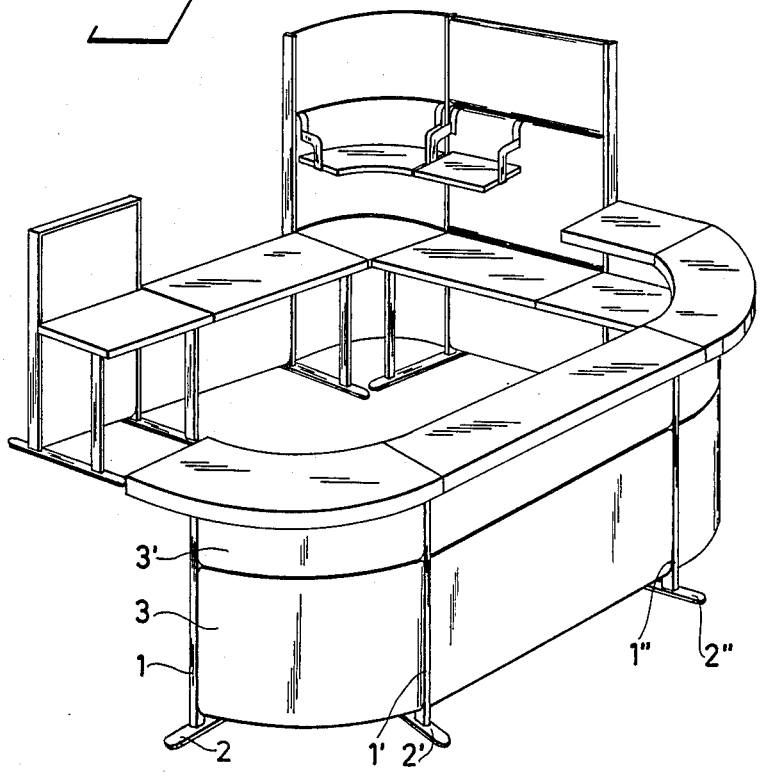
FIG. 2 is a perspective view of another work position, arranged utilizing a partition panel system according to the present invention, and arranged with suitable work heights, both for sitting and standing work.
Figure 3:
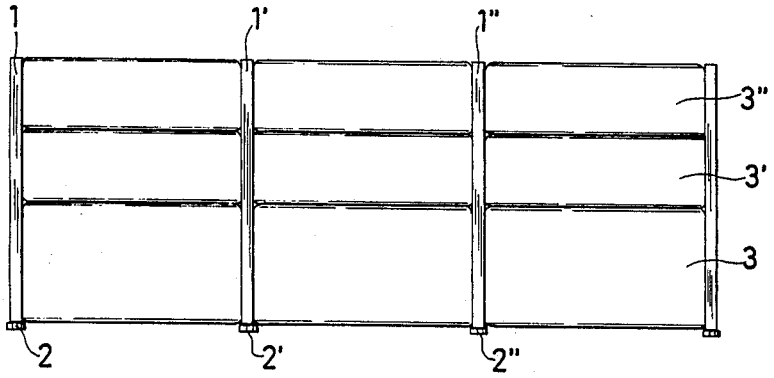
FIG. 3 is an elevational view of a partition panel wall formed by means of three partition panels joined together, each one formed by three adjacently located units in vertical direction of extension.

With reference to FIGS. 1 and 2, examples are shown relating to how a partition panel system according to the present invention can be used in practice. Shown embodiments of partition panels include vertically extending supporting sections 1, 1', 1'', having the lower end portions arranged with transversely extending supporting members 2, 2', 2'', which are in contact with a floor surface. The supporting sections 1, 1', 1'' are utilized for attachment of intermediately located units 3, 3', 3'', located above and/or adjacent to each other and forming a wall surface, which is also shown in FIG. 3, where three such units 3, 3', 3'' are located above each other between each supporting section 1, 1', 1''.

Figure 4:
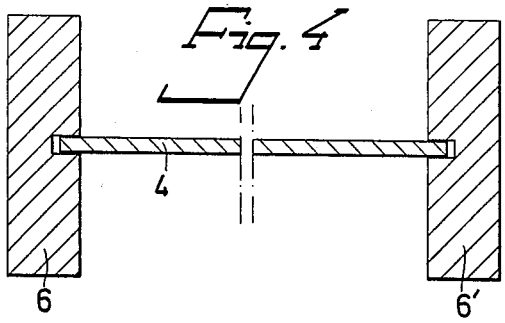
FIG. 4 is a cross sectional view in the horizontal plane of an embodiment of a supporting structure for a unit of the type utilized in FIG. 3 for forming a partition panel.
Figure 5:
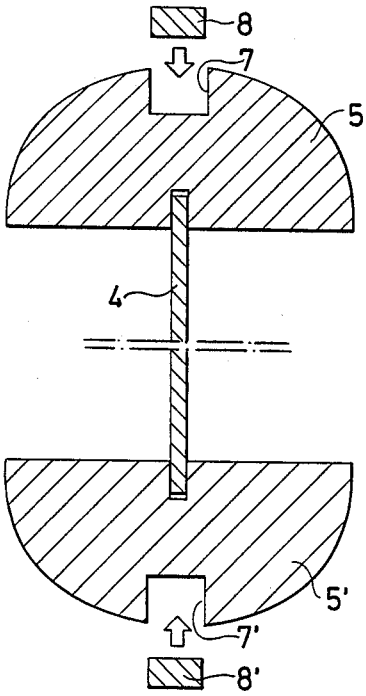
FIG. 5 is a cross-sectional view in the vertical plane of the supporting structure shown in FIG. 4, and with certain included components shown separated from said structure.

The units 3, 3', 3'' utilized to form a wall surface are more fully described with reference to the example of an embodiment shown in FIGS. 4 and 5. This example shows that each unit 3, 3', 3'' includes a centrally located plate-shaped member 4, located in grooves taken up in both an upper and a lower attachment member, 5 and 5' respectively, and also in two side members, 6 and 6' respectively. The upper and the lower attachment members 5, 5' are arranged with a substantially semi-circular cross-sectional configuration, and having the convex surfaces directed away from the plate-shaped member 4. Centrally located longitudinally extending grooves 7, 7' are provided in said convex surfaces, against which two strips, 8 and 8' respectively, can be attached, e.g. by means of nails, screws or similar. The grooves 7, 7' are arranged with a depth, and preferably also a width, exceeding the cross-sectional dimensions of the strips 8, 8'.

Figure 6:
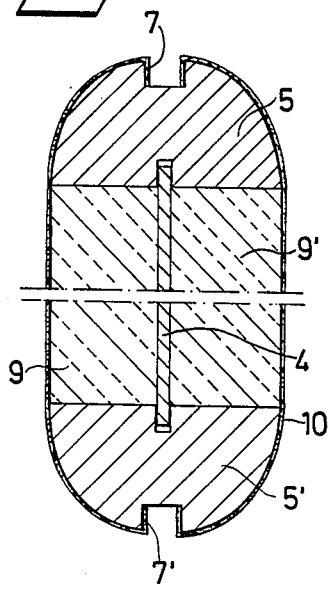
FIG. 6 is a cross-sectional view corresponding to FIG. 5 of an embodiment of a complete unit.

A cross-sectional view of a complete unit 3, 3', 3'' is shown in FIG. 6, but the strips 6, 6' have not been shown. This complete unit includes, apart from previously described elements, also filling members 9, 9' at each side of the centrally located plate-shaped member 4, and an outer layer 10 surrounding the unit, preferably being a textile material. The filling members 9, 9' each comprises advantageously mineral wool panels, but also other materials can obviously be used, such as various types of rubber and plastic materials, as well as other materials having suitable properties. In order to facilitate required stretching of the enclosing layer 10 of cloth, or similar material, the lever is stretched by attachment of previously mentioned strips 8, 8' against the bottom parts of the grooves 7, 7' as shown in FIG. 5.

Figure 7:
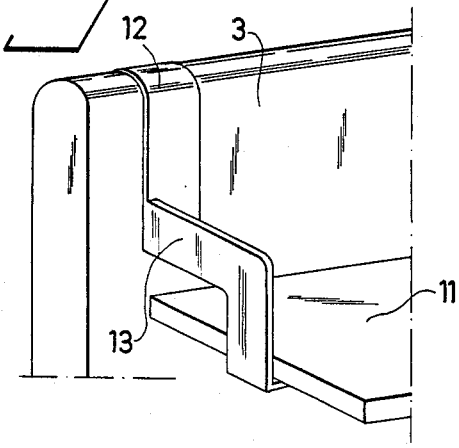
FIG. 7 is a perspective view of a portion of a unit included in a partition panel with an associated supporting bracket arranged for supporting a shelf.
Figure 8:
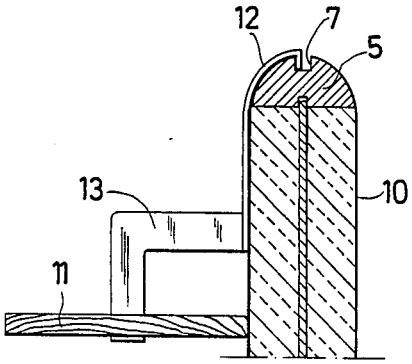
FIG. 8 is an elevational view, partly in cross-section, of the embodiment shown in FIG. 7.

Grooves 7, 7' are also utilized for attachment of shelves, tops, cabinets or other pieces of furniture against a partition panel according to the invention. An example of how such attachment is carried out will now be more fully described with reference to FIGS. 7 and 8, which disclose attachment of a shelf 11. For this purpose, supporting brackets are used, formed by a first strip-shaped member 12, which by means of a bent over portion engages an adjacent side portion of a groove 7. The strip-shaped member is preferably arranged having an extension substantially corresponding to the convex shape of the upper portion of the unit 3 against which attachment is to be made, and is transformed into a part 13 directed away from said unit 3, arranged to facilitate attachment to the shelf 11. It is obvious, that the supporting brackets can be located at any desired locations along the entire longitudinal length of each unit 3, 3', 3'', and that thus shelves or other pieces of furniture, having a considerably shorter extension than the units 3, 3', 3'', can be attached. Attachment of very long pieces of furniture can obviously also be performed, by using a required number of supporting brackets, and by attaching same against a number of units 3, 3', 3'', located adjacent each other at a partition panel erected according to the invention.

The units 3, 3', 3'' utilized to erect partition panel sections are further advantageously arranged having independently different heights, e.g. with the lowermost unit having a height adapted for attachment of a writing top or similar element at desk height, and with adjacent joints in direction upwards utilized for attachment of, for example, shelves. The uppermost unit 3, 3', 3'' can be utilized to support a top forming a desk surface extending in both directions from said unit 3, 3', 3'', e.g. a reception desk as shown in FIG. 2.

Figure 10:
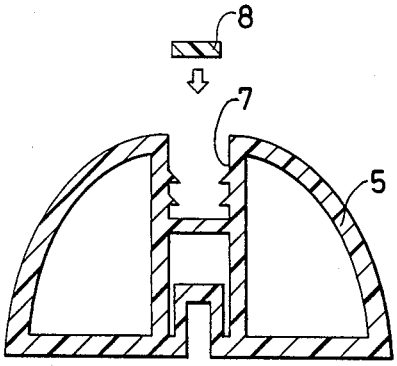
FIG. 10 is a cross-sectional view of an example of a modified section intended to be used when building the units included in a partition panel.

With regard to described embodiments, the upper and lower attachment member 5, 5' are shown having a solid cross-section, e.g. manufactured from wood, but also a non-solid cross-section can obviously be used. An example of this is shown in FIG. 10, and may advantageously be manufactured from a synthetic plastics material. The strip 8 used to hold and stretch the cloth forming a surrounding layer 10 can be attached without use of screws, nails or similar, by arranging the groove 7 with engagement means protruding from the side surfaces, which engage and hold the strip 8 in a position inserted into the groove 7.

Figure 9:
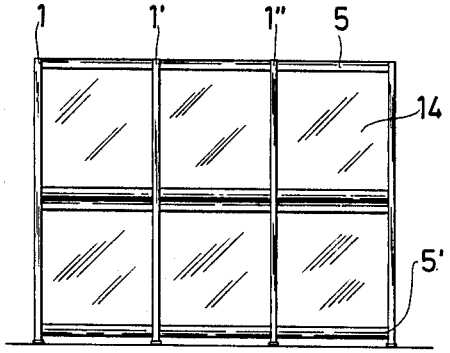
FIG. 9 is a plan similar to FIG. 3 view of a partition panel with glazed units.

Furthermore, partition panels including glazed sections can also be accomplished, in which case the plate-shaped member 4 is replaced by a sheet of plate glass 14, as shown in FIG. 9. In this case, the surrounding layer 10 of cloth or similar material is obviously not used, nor any filling elements 9, 9'. The latter elements 9, 9' may also for certain applications advantageously be excluded from embodiments including a surrounding layer 10 of cloth or similar.

Figure 11:
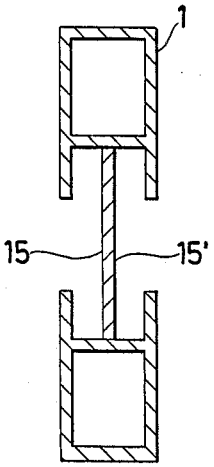
FIG. 11 is a cross-sectional view of an example of a supporting section for the units forming a partition panel.
Figure 12:
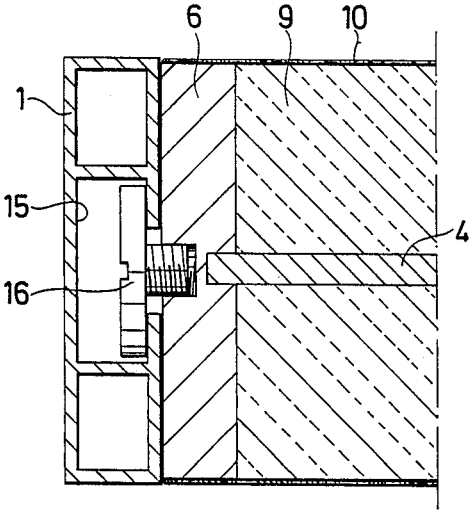
FIG. 12 is a cross-sectional view corresponding to FIG. 11 of an example of a supporting section, intended to serve as the outermost section of a partition panel, and with the units forming a partition panel attached thereto.

The method for attaching the units 3, 3', 3'' against the vertically extending supporting sections 1, 1', 1'' has previously not been discussed, nor the fashion in which sections 1, 1', 1'' can be designed. An example of such a supporting section 1, 1', 1'' is shown in FIG. 11, intended to serve as an example of a section 1, 1', 1'' arranged to be used as an intermediately located section between two elements of a partition panel. The section includes two grooves 15, 15', having the open portions restricted by means of two extending towards each other. The inside surfaces of these two restricting parts are utilized as contact surfaces for attachment means insertable into the grooves 15, 15', which are joined to the side members 6, 6', extending outwardly from same. An example of a supporting section 1, 1', 1'', intended to serve as an outer section restricting the extension of a partition panel, is shown in FIG. 12, and with an example of an attachment means 16 indicated, arranged to hold a unit 3 against the section. The attachment means 16 may in its simpliest form comprise a screw or a bolt, the head of which is used to obtain contact against the internal surfaces of the restricting parts extending towards each other at the opening of the groove 15. In view of the large number of previously known means which may be used to facilitate attachment against grooves 15, 15' of disclosed type, further examples are not considered required.

The examples of supporting sections 1, 1', 1'' disclosed above can obviously be further varied, and for example the number of grooves 15, 15' can be further increased. To accomplish a T-shaped partition panel, three grooves 15, 15' can be arranged, two in an opposed relationship and a third located in a rotated relationship to the other two grooves, in which case said rotated relationship obviously does not need to be 90°. Furthermore, crosswise connection of partition panels can also be accomplished, in which case the number of grooves is increased to four.

The units 3, 3', 3" utilized for erecting a partition panel may further be arranged having a non-linear extension, in order to facilitate erection of curved partition panels, and this has been indicated in FIG. 2, in which the reception desk shown includes such curved units 3, 3', 3", which can be arranged having any desired selected angular extension for the curved sections.

The layer 10, previously mentioned as preferably being cloth or other textile material, can obviously also be other materials, and in this respect also rigid plate-shaped materials. By arranging the outer edge portions of the upper and the lower attachment members 5, 5', and also associated side members 6, 6', with a recess, a rigid plate-shaped member may for example be attached abutting the recess, the depth of which preferably is arranged to correspond with the thickness of the plate-shaped member. Alternatively, and for example, a metal sheet or similar member, having bent over edge portions, can be directly attached against the surfaces directed towards each other of the attachment members 5, 5' and the side members 6, 6'. It is thus possible to produce partition panel units having side surfaces of a substantially rigid material, such as sheet metal, synthetic plastics, wood or any other desired material.

It is also possible, for example as a lower section, to utilize a unit having one or a number of channels for electric or telecommunication wires, and with necessary apertures for attachment of connection means. Furthermore, a covering profile is advantageously arranged attachable against the upper groove 7 of a partition panel, having an outer convex surface matching the upper surface of the partition panel.

The partition panel system according to the present invention makes it possible to vary the appearance of a partition panel in a previously unknown way, both with regard to shape and color, since it makes it possible to erect as desired a partition panel of units 3, 3', 3" having different height and color from each other. Furthermore, rapid and simple attachment of various pieces of furniture can be carried out, completely independent of the longitudinal length of same. The partition panel according to the present invention can thus be regarded as a system for building desired interiors, and the possibility to meet all requirements relating to functional work positions. A partition panel according to the present invention can further be erected in a rapid and simple fashion, or demounted, and it may further be designed to meet a variety of requirements relating to sound absorbing properties.

The examples of embodiments of the present invention shown and described are only intended to serve as examples of embodiments within the scope of the invention, and further modifications are thus possible within the scope of the appended claims.

I claim:

1. Partition panel system including at least two relatively longitudinally spaced and substantially vertically extending supporting sections supported at the lower ends thereof by supporting members adapted to set on a floor surface, comprising:

at least two wall surface units supported by and between said at least two supporting sections, each wall surface unit comprising, a frame-shaped member formed by longitudinally extending upper and lower attachment members and two longitudinally extending side members, at least one plate-shaped member supported by and between said attachment members and side members, upwardly and downwardly facing convexly curved outer edge surfaces on said upper and lower attachment members, respectively, and a longitudinally extending groove in substantially the central portion of each convexly curved outer edge surface;

the at least two supporting sections each having at least one side facing said at least two wall surface units;

a longitudinally extending side groove in said at least one side;

groove-restricting elements extending toward each other on each supporting section to partially close said side groove and having internal surfaces thereon; and attachment means engageable against said internal surfaces and removably engageable with one of said wall surface units for supporting said wall surface units.

2. Partition panel system as claimed in claim 1 and further comprising:

mutually facing inner surfaces on said upper and lower attachment members;

mutually facing inner surfaces on said side members; and longitudinal grooves centrally located on said inner surfaces for retaining engagement with edge portions of said at least one plate-shaped member inserted into said centrally located grooves.

3. Partition panel system as claimed in claim 2, wherein:

said frame-shaped member is wider than said at least one plate-shaped member so that internal spaces are formed between said frame-shaped member, said at least one plate-shaped member and said outer layer; and a filling member is provided for filling at least one of said internal spaces.

4. Partition panel system as claimed in claim 3 wherein:

said at least one filling member comprises a sheet of mineral wool.

5. Partition panel system as claimed in claim 1 wherein:

said at least one plate-shaped member comprises a sheet of light permeable material.

6. Partition panel system as claimed in claim 1 wherein:

said at least one plate-shaped member comprises a sheet of light permeable glass.

7. Partition panel system as claimed in claim 1 wherein:

said at least one plate-shaped member comprises a sheet of light-permeable plastic.

8. Partition panel system as claimed in claim 1 wherein:

said at least two wall surface units have different lengths in the direction of extension of said side members.

9. Partition panel system as claimed in claim 1 and further comprising:

a strip-shaped member insertable into each longitudinally extending groove and having a height less than the depth of the respective groove;

a surrounding outer layer comprising a textile material stretched over said frame-shaped member and extending into said longitudinally extending grooves, said strip-shaped members retaining said outer layer in place by engagement therewith in said longitudinally extending groove;

mutually facing inner surfaces on said upper and lower attachment members;

mutually facing inner surfaces on said side members;

longitudinal grooves centrally located on said inner surfaces for retaining engagement with edge portions of said at least one plate-shaped member inserted into said centrally located grooves;

said frame-shaped member being wider than said at least one plate-shaped member so that internal spaces are formed between said frame-shaped member, said at least one plate-shaped member and said outer layer; and a filling member comprising a sheet of mineral wool filling at least one of said internal spaces.

10. Partition panel system as claimed in claim 9 and further comprising:

at least one supporting bracket engageable with said at least one wall surface unit; and at least one attachment element on said at least one supporting bracket engageable in said groove in the upper convexly curved edge surface of a respective wall surface unit for connecting said at least one supporting bracket to said respective wall surface unit.

11. Partition panel system as claimed in claim 10 and further comprising:

a substantially planar member having a part engageable in said groove in the upper convexly curved edge surface of at least one wall surface unit for supporting said planar member on said at least one wall surface unit extending in a plane transverse to and in at least one direction from the plane of said plate-shaped member.

12. Partition panel system as claimed in claim 11 wherein:

said at least two wall surface units have different heights.

13. Partition panel system including at least two relatively longitudinally spaced and substantially vertically extending supporting sections supported at the lower ends thereof by supporting members adapted to set on a floor surface, comprising:

at least two wall surface units supported by and between said at least two supporting sections, each wall surface unit comprising, a frame-shaped member formed by longitudinally extending upper and lower attachment members and two longitudinally extending side members, at least one plate-shaped member supported by and between said attachment members and side members, upwardly and downwardly facing convexly curved outer edge surfaces on said upper and lower attachment members, respectively, and a longitudinally extending groove in substantially the central portion of each convexly curved outer edge surface;

at least one supporting bracket engageable with said at least one wall surface unit; and at least one attachment element on said at least one supporting bracket engageable in said groove in said upwardly facing convexly curved outer edge surface of a respective wall surface unit for connecting said at least one supporting bracket to said respective wall surface unit.

14. Partition panel system including at least two relatively longitudinally spaced and substantially vertically extending supporting sections supported at the lower ends thereof by supporting members adapted to set on a floor surface, comprising:

at least two wall surface units supported by and between said at least two supporting sections, each wall surface unit comprising, a frame-shaped member formed by longitudinally extending upper and lower attachment members and two longitudinally extending side members, at least one plate-shaped member supported by and between said attachment members and side members, upwardly and downwardly facing convexly curved outer edge surfaces on said upper and lower attachment members, respectively, and a longitudinally extending groove in substantially the central portion of each convexly curved outer edge surface; and a substantially planar member having a part engageable in said groove in the upper convexly curved edge surface of at least one wall surface unit for supporting said planar member on said at least one wall surface unit extending in a plane transverse to and in at least one direction from the plane of said plate-shaped member.

* * * * *